United States Patent [19]

Kilian

[11] 4,024,683

[45] May 24, 1977

[54] FIXING CLAMP FOR LAYING WALL TILES

[75] Inventor: Heinz Kilian, Huttental-Geisweid, Germany

[73] Assignee: Irle Deuz GmbH, Germany

[22] Filed: Sept. 12, 1975

[21] Appl. No.: 612,807

[30] Foreign Application Priority Data

Sept. 16, 1974 Germany ..... 2444156
July 12, 1975 Germany ..... 2531304

[52] U.S. Cl. ..... 52/98; 52/127; 52/285; 52/384; 52/509; 52/584

[51] Int. Cl.² ..... E04B 1/41

[58] Field of Search ..... 249/91, 93, 219 R; 52/98, 584, 127, 587, 100, 447, 384, 391, 744, 760, 747, 758 D, 509, 582, 285; 46/31, 30; 24/73 P, 73 PF

[56] References Cited

UNITED STATES PATENTS

| | | | |
|---|---|---|---|
| 611,514 | 9/1898 | Schratwisier | 52/447 X |
| 2,712,200 | 7/1955 | Dearling | 46/30 X |
| 2,752,580 | 6/1956 | Shewmaker | 24/73 PF X |
| 2,961,779 | 11/1960 | Perry | 46/31 X |
| 3,067,536 | 12/1962 | Brittsan | 24/73 PF |
| 3,688,635 | 9/1972 | Fegen | 24/73 PF X |
| 3,748,007 | 6/1973 | Mathias | 52/98 X |
| 3,750,997 | 8/1973 | Andersen et al. | 249/219 R X |
| 3,861,098 | 1/1975 | Schaub | 52/98 |
| 3,874,133 | 4/1975 | Silvius | 52/285 X |
| 3,902,215 | 9/1975 | Waldrop et al. | 24/73 P |
| 3,961,453 | 6/1976 | Couwenbergs | 52/509 |

FOREIGN PATENTS OR APPLICATIONS

| | | | |
|---|---|---|---|
| 224,327 | 4/1962 | Austria | 52/582 |
| 567,221 | 12/1958 | Canada | 249/219 |
| 1,401,015 | 4/1965 | France | 46/31 |
| 2,221,753 | 8/1973 | Germany | 52/127 |
| 2,301,169 | 7/1974 | Germany | 52/509 |
| 2,028,912 | 12/1971 | Germany | 46/31 |
| 41,806 | 11/1965 | Germany | 52/584 |
| 957,163 | 1/1957. | Germany | 249/192 |

*Primary Examiner*—Leslie Braun
*Attorney, Agent, or Firm*—Craig & Antonelli

[57] ABSTRACT

A fixing clamp arrangement for laying wall tiles which includes a front and rear plate which are releasably connected to each other by way of at least one plug arranged on one of the plates and at least one socket arranged on the other of the plates for receiving the plug. One of the plates is provided with at least one projection which extends out of the plane of the plate on one surface thereof and a number of further projections extending out of the plane of the other surface thereof with the projections on the respective surfaces being arranged such that in a first connected condition of the two plates, the at least one projection defines a single joint and in a second connected condition of the two plates, the number of projections define two intersecting joints.

31 Claims, 8 Drawing Figures

FIXING CLAMP FOR LAYING WALL TILES

The present invention relates to a fixing clamp for laying wall tiles, having a rear plate and a front plate located a distance therefrom which corresponds to the thickness of the tiles, the plates being connected one with the other through separable connecting means.

A fixing clamp of this type is known from German Published Patent Application No. 2,221,753. The known fixing clamps are employed in the following manner. The lowest row of tiles of a wall first be set up at a distance from the wall. In setting up the tiles, it can be practical to employ special aids, e.g. a laying lath, which simplify precise alignment of the tiles. After setting up the lowest row of tiles, the fixing clamps are pushed onto the upper edges of the lowest row of tiles in the area of the vertical joints and the tiles in the lowest row are connected with the wall by pouring mortar or any other attaching material behind them. It can be advantageous to fill enough mortar between the tiles and the wall that the mortar extends to a point just below the upper edge of the tiles. After pouring mortar behind the lowest row of tiles and after the mortar has hardened behind these tiles, the corners of the tiles of the next row are then pushed into the fixing clamps and after fixing clamps have been pushed onto their upper edges mortar is also poured behind them. All further rows of tiles are constructed in the same manner. Subsequently, only the front portions of the fixing clamps are removed by tearing off the tear-off ridge, while the rear portions of the fixing clamps remain between the tiles and the wall. The disadvantage of the known fixing clamp is that is can only be employed once, as it is destroyed by tearing off the tear-off ridge; the front plate must therefore be thrown away after being torn off, which involves relatively high expenses for materials.

It is the object of the present invention to provide more economic utilization of the fixing clamp. According to the present invention, this object is solved in that the entire front half of the clamp, removed after the mortar has hardened, can be reused in that the means connecting the rear plate and the front plate are of the plug and socket type.

The advantage of the invention is that even if the plug and socket connection elements on the rear and front plates are not designed in the same manner but are designed in such a manner that they match, the front plates, which are removed after mortar has been poured behind the tiles, can be reassembled with rear plates to form complete fixing clamps again, so that there is no waste. Thus, the amount of material required for the fixing clamps is advantageously reduced.

The plug and socket connections can be designed in various manners; for example, it is possible to provide only one element of the plug and socket connection in each plate, such as a hole, and to provide the other element of the plug and socket connection, such as a stud, as a separate component. Then, two plates designed in the same manner, at least with respect to the plug and socket connection, are connected one with the other, with the aid of one or more separate studs to form a fixing clamp. After the plates have been separated, it is then only necessary to provide a sufficient supply of studs in order to connect the removed front plates if the studs cannot be removed from the rear plate together with the front plate because they are retained by the mortar, for example.

In an embodiment of the present invention incorporating non-uniform design of the elements of the plug and socket connection, however, each plate contains both elements of the plug and socket connection, with each group of elements, e.g. studs on the one hand and engagement holes on the other, being arranged in the same distance pattern. Since the same distance pattern is provided for both groups of the plug and socket connection elements, each plate can thus be assembled with any other plate. If the plates have only one single element of a plug and socket connection on one side of the plate, it is of course not possible to speak of a distance pattern of the elements of a group of elements. However in this latter case, it is practical to arrange the element in such a manner that there is largely coincidence between the two plates after they have been assembled to form a fixing clamp, so that the fixing clamp can perform its function.

It is possible to provide only one single type of plug and socket elements on a given side of a plate, i.e. studs or holes. In order to permit each plate to be combined with any other plate to form a fixing clamp, the other tupe of plug and socket connection elements are then arranged on the other side of the plate. However in an embodiment of the invention both groups of elements are arranged on at least one side of a plate. This permits the other side of the plate to be designed entirely free of connecting elements, or it is also possible to provide the connecting elements in different arrangements on both sides of the plates, so that different types of fixing clamps result, depending upon with which sides facing each other the plates are assembled into a fixing clamp. In this type of embodiment, in which both groups of elements are arranged in at least one side of a plate, it is also possible to only provide one of each of the two various elements of a plug and socket connection on each side, e.g. only one hole and only one stud. The distance between these two different types of elements must then be the same on those sides of the plates which are to face each other when a fixing clamp is formed so that a total of two plug and socket connections can be formed.

According to an embodiment of the invention, the above-described distance patterns of the two groups of elements can be arranged in such a manner that the configuration of one of the groups of elements can be brought into coincidence with the configuration of the other group of elements by rotating it about an axis extending at right angles to the plane of the plates. The arrangement can be designed in such a manner that a rotation of 180°, for example, or 90° is required in order to provide conincidence between both configurations. The arrangement can also be designed in such a manner that coincidence can be provided between the two configurations by shifting them in a linear manner; for example, the two elements of the plug and socket connection can be provided alternately and equidistantly along a straight line. With this arrangement, there is alos coincidence between the two groups of elements if the plates are rotated about a suitably selected axis of rotation extending at right angles to the plane of the plates.

From the above-mentioned German Published Patent Application No. 2,221,753, it is already known practice to provided projections projecting fom the plane of the plate for stipulating a joint: For either one single joint, extending in a straight line, or for two intersecting joints. According to an embodiment of the invention, on the other hand, at least one projection for stipulating a single joint is arranged on one side of the plate and projections for stipulating two intersecting joints are arranged on the other side of the plate. The advantage of this is that two plates can be assembled to form either a clamp for intersecting joints or a clamp which can be shifted in any desired manner with a joint, depending upon which sides of the plates face one another. The width of the projections is equal to that of the joint, so that it is not possible to push the tiles fixed by the clamps closer together than the desired joint width.

According to an embodiment of the invention, it is possible to simultaneously design at least one plug and socket connection as a projection stipulating the joint width; in this case, the plug and socket connection serves both to connect thw two plates and to stipulate the joint width.

The projection can have a stop surface for the projection which is opposite thereto when the plates are assembled; in this case, the stop surfaces of the two above-mentioned projections are in a contacting relationship one with the other, thereby stipulating the distance between the plates, which corresponds to the tile thickness. The stop surface can be arranged at the highest point of the projection, however it can also be arranged in such a manner that a portion of the projection extends therebeyond. In this case, that portion of the projection which extends beyond the above-mentioned stop surface can also have a stop surface.

If a projection of a plate is located opposite a hole arranged in the plane of the other plate of the fixing clamp, the above-mentioned projection can be longer than the tile thickness, and then penetrates into the above-mentioned hole. However it is of particular advantage if, according to an embodiment of the invention, the projection is shorter than the tile thickness; in this case, this projection then does not protrude from the joint between adjacent tiles when the front plates of the fixing clamps are removed. If projections of the two plates of the fixing clamp are located one opposite the other and if these projections do not simultaneously form a plug and socket connection, the sum of the lengths of the two projections (measured perpendicular to the plane of the plate) should not be greater than the desired distance between the plates of the fixing clamp, which corresponds to the tile thickness. If the two opposite projections are of equial length, they may therefore only be half as long as the tile thickness. However the projections can also be shorter. If, on the other hand, the projections also form plug and socket connections, the total length of the projections must be longer than the tile thickness in order to permit them to be inserted one into the other. The length of the two projections, for example, can advantageously correpsond to two-thirds of the tile thickness; in this case, sufficient insertion of the two projections forming the plug and socket connection one into the other is possible, and these projections nevertheless do not protrude from the joint after the front plate of the fixing clamp has been removed. These projections can therefore easily be concealed by the joint cement employed for pointing the joints after the front plates have been removed.

The elements of the plug and socket connection are preferably a stud and a hole for receiving the stud. It is not absolutely necessary for stud and hole to be of uniform design; however in an embodiment of the invention the stud and the hole are of tapered design. The hole can be a hole in the plate; in an embodiment of the invention, however, the hole is formed by the gap between the clamping jaws arranged at a distance one from the other. This offers the advantage of being able to attain a long hole length in the insertion direction and a secure seat of the stud in the hole, and thus firm assembly of the fixing clamp.

It is possible to design the arrangement in such a manner that the stud is held in the hole merely through friction. In an embodiment of the invention, however, the plug and socket connection is of the engagement type. In particular, the end of the stud can be widened in the manner of a snap fastener, with this widened end then engaging the hole which extends through the plate. The engagement connection is designed in such a manner as to permit the two plates combined to form a fixing clamp to be separated in a non-destructive manner. In order to limit the insertion depth of the plug and socket connection in such a manner as to precisely provide the desired distance between the two plates of a fixing clamp when they are assembled, in an embodiment of the invention there is at least one stop for limiting the insertion depth on each plate.

In an embodiment of the invention, the stud of the plug and socket connection is connected with the plate by means of a predetermined breaking point; breaking off the studs of the rear plate remaining in the wall after the front plate has been removed dependably prevents even long studs from protruding from the joints.

As provided in an embodiment of the invention, it is advantageous for the plug and socket connections to be arranged at a distance from the edges of the plate, thereby permitting a U-shaped aligning strip to be inserted over the upper edges of the plates of a row of fixing clamps inserted on a row of tiles.

In an embodiment of the invention, a plate contains means for connecting two plates at an angle, thereby permitting tiles to be laid at an inner or outer corner of a wall. In an embodiment of the invention, these means are designed as U-shaped hooks arranged in the plane of the plate, with one hook operating conjointly with a hook of precisely the same design of another, rotated plate in such a manner that both plates can be connected one with the other at a right angle.

In an embodiment of the invention, the plate has at least one projection arranged in its plane, the projection pointing toward the corner formed by fixing clamps connected at an angle. This projection can be designed in such a manner as to stipulate the width of the joint between the tiles abutting in the corner; in the practical example described later, this projection is arranged on that side of the plate facing the means for connecting two plates at an angle. The projection can also be designed in such a manner as to form a stop for the corners of the tiles abutting at an angle in the inner or outer corner of a wall. In the practical example described later, this projection is arranged on the same side of the plate on which the means for connecting the plates at an angle are also arranged, so that the described practical example has both projections for stipulating the joint width as well as a projection for supporting the corners of the tiles.

According to an embodiment of the invention, the above-mentioned projections can be broken off. This embodiment is practical since the projections which form the stops for the tiles abutting in the corner can be removed if necessary in this manner, thereby permitting one of the tiles abutting in the corner to be placed in the proper position without hindrance as a result of the broken-off projections. Breaking off the projections does not impair the reusability of the plate if the plate is then employed in a location where the projection is not required, such as for laying tiles in an area which is not located directly at the corner of the wall. In order to ensure that the point of break at which the projection is broken off does not interferingly protrude at the edge of the plate, in an embodiment of the invention a predetermined breaking point for the projection is arranged in such a manner that it recedes from the edge of the plate, i.e. is arranged in an inwardly displaced manner.

In view of the above-described embodiments, it is practical, as provided in an embodiment of the invention, for the thickness of the plates, at least in the area of a peripheral reinforcing border, to correspond to the joint width. The reamining areas of the plates, on the other hand, can be thinner, thereby permitting material to be saved.

In an embodiment of the invention, the plate has at least one spring tongue projecting beyond the plane of the plate. This spring tongue supports the tiles if, as a result of tile thickness inaccuracies, they are not as thick as the distance between the two plates of the fixing clamp. It is practical for the number of spring tongues arranged on each plate to at least equal the number of tiles to be connected one with other by one single fixing clamp, i.e. normally four spring tongues. If, in addition, the two plates should be able to be combined to form a fixing clamp with either of their sides facing each other, it is practical for the spring tongues to project on both sides of the plate, so that it is practical to provide at least four pairs of spring tongues. In order for the spring tongues to ensure that the tiles can be slide into the fixing clamp easily, it is practical for the arrangement to be designed in such a manner that the free ends of the spring tongues extend generally diagonally toward the center of the plate. If a total of eight pairs of spring tongues is provided, both the front and rear sides of each individual tile can be supported by two spring tongues each, thereby proving the support of the tiles. In this embodiment, it can be practical for the spring tongues to be arranged at an angle of 30° from the vertical median line of the plate.

In an embodiment of the invention, a plate can be divided along at least one predetermined breaking line. This offers the advantage of also being able to employ the fixing clamps for narrow (trimmed) rows of tiles, e.g. in room corners, as the fixing clamps are designed in such a manner that they can be divided. If there are two intersecting predetermined breaking lines, the plate can be divided in either one or the other direction, as desired, and can be divided into a total of four sections, thereby permitting them to be employed around openings, i.e. in the vicinity of holes for valves and fittings. It is possible that if the plate is divided into two or four sections in such a manner not all of the individual sections will have fixing elements; however the arrangement can also be designed in such a manner that a sufficient number of fixing elements is distributed on the plate in such a manner that each of the individual sections has at least one connecting element and can therefore be employed for assembly with another individual section for forming a small fixing clamp.

In an embodiment, a plate has a through hole in the area of the intersecting joints. This hole will generally be located in the area of the center of the plate. The advantage is that the exact location of the tiles to be connected by the fixing clamp can be observed through the opening. In addition, if the rear plate has an opening of this type the corners of the tiles can be well supplied with mortar.

In order for each front plate of a fixing clamp to be able to be employed again, it is merely necessary for the plug and socket connections of the individual plates to coincide; however it is not necessary for the plates themselves to be of entirely the same design. In a preferred embodiment of the invention, on the other hand, the front and rear plates are designed in entirely the same manner; this simplifies fabrication as both the front and rear plates can be fabricated with only one single tool.

In order to simplify insertion of the fixing clamp onto the existing row of tiles and insertion of the tiles of the next row into the fixing clamp, according to an embodiment of the invention the edges of the plates can be rounded or bevelled on both sides.

The plates can be of differing configuration; in an embodiment of the invention, they are generally rectangular, and the joints stipulated by the projections for stipulating the joints extend parallel to the edges of the plate. This embodiment is especially well suited for laying the rectangular or square tiles generally employed. In an embodiment in which the plates have predetermined breaking lines, these predetermined breaking lines extend parallel to the edges; this offers the advantage that the individual sections formed by dividing the plate are of rectangular configuration, and can therefore also be employed in an especially simple manner. A further advantage offered by the rectangular configuration of the plates is that because of this rectangular configuration the fixing clamps can be employed either vertically or horizontally, i.e. they can also be employed for the narrow rectangular tiles which have lately been popular.

The above discussed and other objects, features and advantages of the present invention will become more apparent from the following description of practical examples thereof, when taken in connection with the accompanying drawings, showing significant details, and from the claims. The individual characteristics can be realized either individually, or in any desired combination, in an embodiment of the present invention. In the drawings FIG. 1 shows a perspective representation of a plate of a practical example of a fixing clamp according to the present invention from one side;

Figure 1:
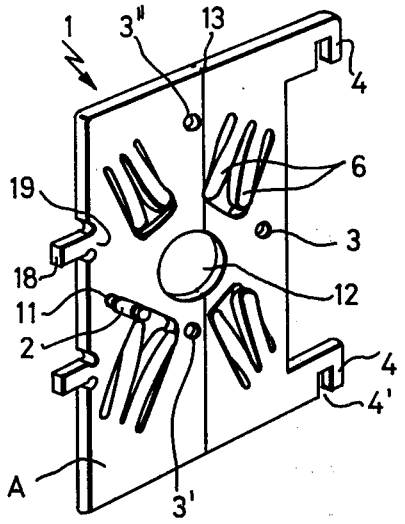
Figure 2:
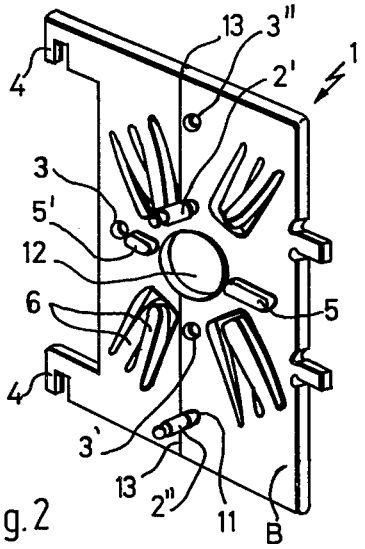
FIG. 2 shows the same plate from the other side.
Figure 3:
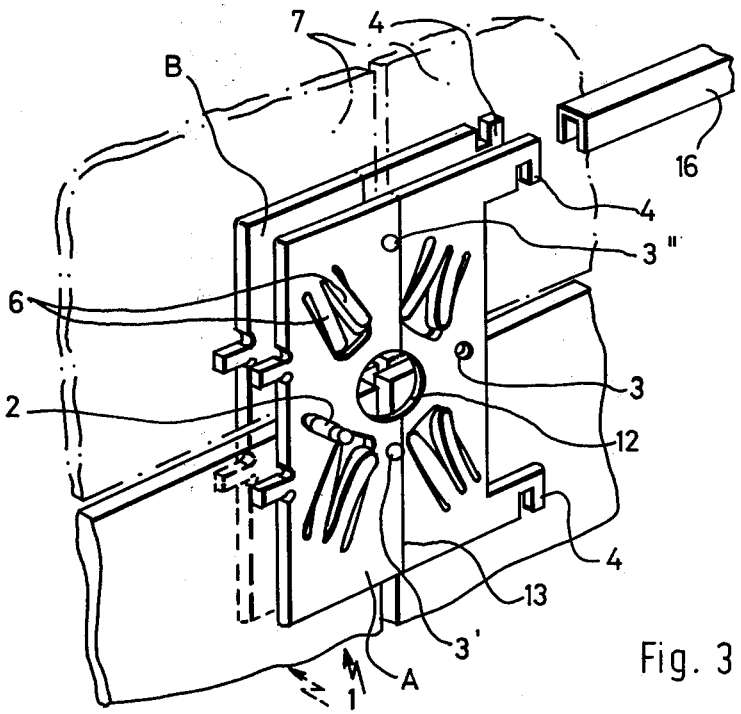
FIG. 3 shows a fixing clamp, arranged in an upright manner.
Figure 4:
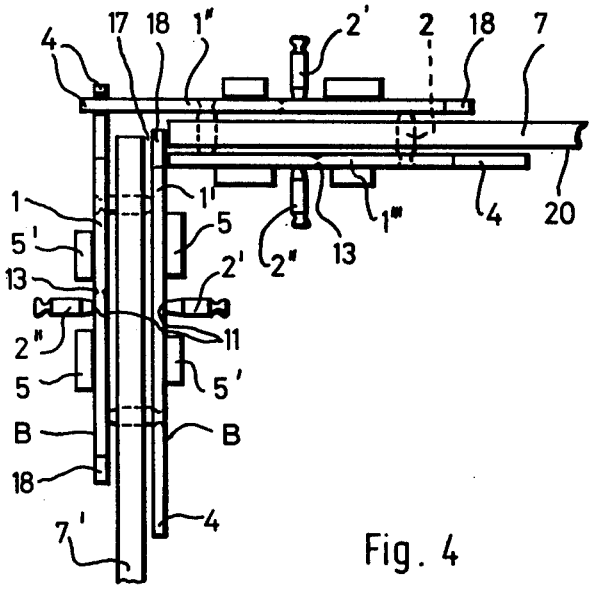
FIG. 4 shows the employment of the fixing clamp at an inner corner of a room.
Figure 5:
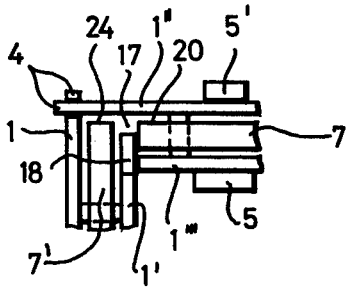
FIG. 5 shows, partially broken away, the employment of the fixing clamp at an outer corner of a room.

Referring now to the drawings, wherein like reference numerals designate like parts throughout the several views, each of the fixing clamps shown in FIGS. 3 to 5 comprises two of the same plates, shown from both asides A and B in FIGS. 1 and 2. Plates 1, and thus also the fixing clamps, are of generally rectangular design and have dimensions which also permit rectangular, narrow tiles to be laid in rows with the fixing clamps.

It is practical for the thickness of each plate 1 to correspond to the joint width (e.g. 2.5 mm/0.1 in). Plates 1 are preferably of plastic. While the plastic employed should be tough, it should nevertheless permit the plate 1 to break at the predetermined breaking points, as will be described below. Arranged on each plate 1 at right angles to the plane thereof are a total of three snap-fastener studs 2, 2′ and 2″; snap-fastener stud 2 is arranged on the horizontal median line on side A (FIG. 1) in the vicinity of the left-hand longitudinal edge in FIG. 1, however at a distance therefrom. Arranged on this horizontal median line at the same distance from the right-hand longitudinal edge in FIG. 1 is a locking hole 3, so that when assembled with these sides A facing one another, two plates 1 form a fixing clamp, which can be shifted in any desired manner within a joint between two tiles. Arranged alternately from top to bottom along the vertical median line on said B (FIG. 2) are a locking hole 3″, snap-fasterner stud 2′, a locking hole 3′ and snap-fasterner stud 2″. Also arranged on this side B are two ridge-like projections 5 and 5′, which are located on the horizontal median line and whose width is equal to the desired joint width. The height of projections 5 and 5′ is equal to one half of the tile thickness. If two plates 1 are assembled with their sides B facing one another in such a manner that the head of snap-fastener stud 2″ enters locking hole 3″ and the head of snap-fastener stud 2′ enters locking hole 3′, a cross joint, i.e. two joints intersecting at right angles, can be provided with this fixing clamp, cf. FIG. 3. The two snap-fastener studs 2′ and 2″ are arranged in a vertically extending joint and projections 5 and 5′, arranged one opposite the other, of the two plates 1 are arranged in a horizontal joint. To assemble the two plates 1 to form this clamp according to FIG. 3, the plate shown in FIG. 2, for example, is taken in the hand, rotated 180° in its plane and placed against the plate 1 shown in FIG. 1 from the rear, so that the sides B of each plate 1 are facing one another. In FIG. 3 this can also be seen by the U-shaped notches in hook-shaped noses 4, which project over a longitudinal edge of plate 1 at both the top and bottom ends of the plate and whose purpose will be explained below. The U-shaped notches of the two plates 1, which extend parallel to the vertical median line of plates 1, are open in different directions in FIG. 3, one facing upward and the other downward.

In the illustrated practical example, snap-fastener studs 2, 2′ and 2″ have round cross sections and their diameters correspond to the width of the joint, so that they fix this width. The ends of snap-fastener studs 2, 2′ and 2″ and locking holes 3, 3′ and 3″ are formed in such a manner and have dimensions that are so coordinated one to the other that the snap-fastener studs can engage the locking holes and that this engagement can be eliminated again without damage.

To compensate for irregularities, e.g. surface camber, of the tiles or fluctuations in the tile thickness, spring tongues 6 are integrally formed into each plate 1 and arranged in pairs. One spring tongue 6 of each pair protrudes from side A and the other spring tongue of each pair from side B of the plate. Spring tongues 6 are arranged parallel to the respective diagonals of plate 1, with their free ends pointing toward the center of the plate.

In the drawing, for reasons of simplicity plates 1 are illustated as being of uniform thickness. However it is also possible to design a large portion of the surface of plates 1 thinner, whereby their periphery and interior can be reinforced up to joint width in a rib-like manner, thereby saving material. Thus, the material can also be thinner in the area of spring tongues 6, so that the spring force of spring tongues 6 is not too great. If the fixing clamp shown in FIG. 3, which is arranged in an upright manner, is rotated 90° in its plane, it can then be employed in precisely the same manner as in the attitude shown in FIG. 3; however the horizontal attitude is especially suitable if only a narrow row of tiles remains under the ceiling of a room or if narrow rectangular tiles are to be laid horizontally along their longitudinal edges. In this attitude the fixing clamp can also be employed for the first row of tiles, with snap-fastener studs 2 along the horizontal median line permitting rectangular support of the plate, and thus of the entire fixing clamp. To simplify insertion of the tiles 7 into the fixing clamps, all edges of plates 1 are rounded or bevelled on both sides. After the fixing mass (mortar, two-component plastic or other joint filling compounds) poured behind tiles 7 has hardened or cured and prior to pointing the joints with joint cement, the front plate 1 (FIG. 3) of the fixing clamp is released. Since snap-fastener studs 2 of the rear plate 1, which is embedded in the joint filling compound and remains on the wall, extend from the joint these snap-fastener studs 2 must be removed. It is practical for the plastic from which plates 1 are fabricated to have the characteristic of breaking when subjected to a sudden bending strain, but to react in a tough and resistant manner if slowly subjected to a strain, thereby permitting snap-fastener studs 2 protruding from the joints to be broken off by rapidly wiping an object which does not scratch tiles 7 along the joints. In order to ensure that snap-fastener studs 2 break off deep inside the joint, their base tapers to a predetermined breaking point 11. However this predetermined breaking point 11 does withstand the tensile load to which it is subjected when the snap-fastener-type connection is disengage, i.e. when the front plate 1 is removed. For this reason, the front plate is not damaged upon disengagement and can be reused.

Arranged in the center of each plate 1 is an opening 12 extending through the plate, thereby permitting the corner areas of tiles 7 of a cross joint to be seen (see FIG. 3). Since each rear plate 1 also has this opening 12, the corner areas of tiles are also well supplied with joint filling compound.

Since plate 1 has a predetermined breaking line 13 (only suggested in the drawing), it is thereby possible to divide each plate 1 in half (e.g. if laying narrow rows of tiles). It is practical for this predetermined breaking line to extend past snap-fastener studs 2′and 2″ and corresonding locking holes 3′ and 3″, parallel to the vertical median line of plate 1.

As can be seen from FIG. 3, snap-fastener studs 2, 2′ and 2″ are arranged at such a distance from the respective edge of plate 1 that a U-channel 16 (FIG. 3) can be placed over the upper edge of the fixing clamps, placed on a row of tiles, for the purpose of aligning the row.

In the drawing, snap-fastener studs 2 are illustrated as being round (diameter equal to the joint width). However they can also have a square or rectangular configuration. Moreover, the configuration of the snap-fastener-like holes can also be different from that shown in the drawing.

It is possible for the front plates 1 of the fixing clamps to be disengaged by inserting a hook-shaped tool or a tool having a plurality of spreadable hooks between the tiles through opening 12, acting upon the surface of the front plate facing the rear plate from this position. Another possibility is to provide a shoulder or a diametrically opposed ridge in the area of opening 12, behind which a suitable tool can be hooked.

The employment of fixing clamps according to the present invention for laying tiles at an inner corner will now be described on the basis of FIG. 4. However it should first be pointed out that it is also practical not to employ diagonal joints for the inner corner, but a joint which is located on the plane of the joints of one wall. In FIG. 4, this is the plane of the wall coming from the right.

In order to provide a corner connection, four plates 1, designated 1, 1', 1'' and 1''' in FIG. 4 for purposes of easier differentiation, are employed. Every two of these plates are assembled with their A sides facing one another, so that hook-shaped noses 4 of both plates 1 and 1', connected to form a fixing clamp, a hook-shaped noses 4 of the two other connected plates 1'' and 1''' are located on opposite sides of the respective fixing clamps, as shown in a top view in FIG. 4. Since the A sides of the plates face one another in both fixing clamps, it is merely necessary to arrange snap-fastener studs 2 within a horizontal joint; no vertical joint is necessary, as snap-fastener studs 2' and 2'', which are arranged on the B sides, are located on the outside of the fixing clamps. For this reason, the fixing clamps can be shifted in any desired manner within a horizontal joint.

The two fixing clamps are connected one with the other at right angles in such a manner that the hook-shaped noses 4 of plates 1 and 1'', which face the unillustrated wall which forms an inner corner, engage one with the other in such a manner that the hooks of plate 1 are open toward the top while the hooks of plate 1'' are open toward the bottom. Since the height of U-shaped notches 4'' is equal to one half of the height of hook-shaped nose 4, and since the width of notch 4'' is equal to the thickness of plate 1, the two plates 1 and 1'' can be hooked one into the other in such a manner that their upper and lower longitudinal edges are in alignment one with the other.

Plates 1 have joint studs 18 on the longitudinal side facing away from hook-shaped noses 4 (cf. FIG. 1 and 2). These joint studs 18 are connected with plate 1 over a predetermined breaking point 19 set back somewhat from the longitudinal edge of plate 1. Joint studs 18 of plate 1' form a stop for tile 7 and prevent it from being pushed further to the left than the position shown in FIG. 4. Joint studs 18 of plate 1'', on the other hand, have been broken off in order to permit tile 7' to be pushed far enough toward the corner to form a proper corner joint 17 in the area of the exposed sides 20 of tiles 7 and 7'. Although joint studs 18 of plate 1''' have been broken off, after this plate has been separated from plate 1'' by pulling apart the snap-fastener-like connection it can be reused wherever joint studs 9 are not required.

The relative attitude of the individual plates of the fixing clamps in the arrangement according to FIG. 5 for laying tiles on an outer corner of a wall coincides entirely with the arrangement of the plates in FIG. 4. The major difference between FIGS. 4 and 5 is that in the inner corner shown in FIG. 4 plates 1 and 1'', with the engaged U-shaped hooks, are arranged between the tiles and the wall, and therefore remain in the wall, while in the outer corner (FIG. 5) these engaged plates can subsequently be removed. Another difference is the face that in the inner corner (FIG. 4), if necessary the left tile 7' can be pushed far enough into the corner so that it comes into a contacting relationship with plate 1'', while in the outer corner (FIG. 5) tile 7' must be laid flushly in order to provide a precise corner joint 8, i.e. the end 24 of tile 7' must be aligned with the exposed side 20 of tile 7.

Figure 6:
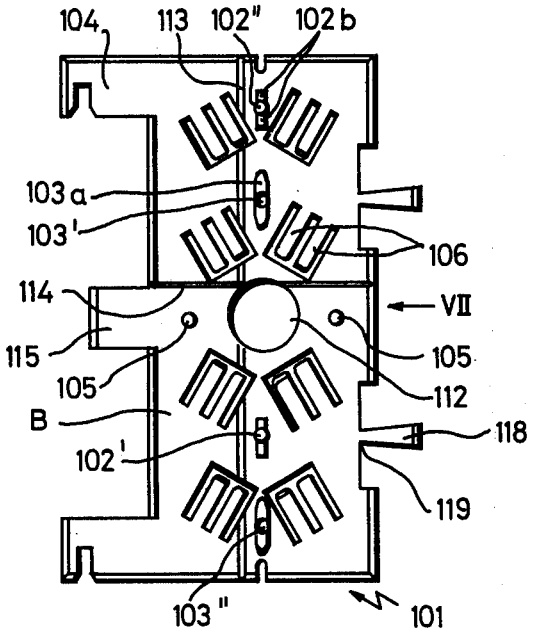
FIG. 6 shows a view, corresponding to that of FIG. 2, of a plate of a different practical example of a fixing clamp according to the present invention from one side.
Figure 7:
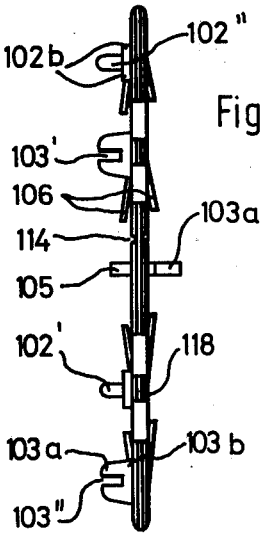
FIG. 7 shows a view of the plate shown in FIG. 6 in the direction of arrow VII in FIG. 6.
Figure 8:
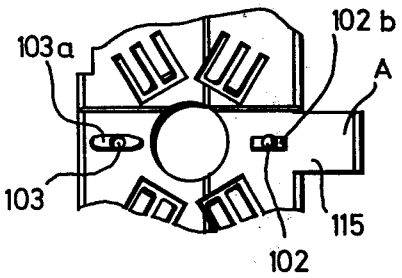
FIG. 8 shows, partially broken away, a view of the plate shown in FIG. 6 from the other side.

In the fixing clamp described below on the basis of FIGS. 6 to 8, those components described above and designated with reference numerals 1 to 6, 12, 13, 18 and 19 are provided in the same or in a functionally similar manner and are designated with a reference numeral that is one hundred higher than the numeral in the above-described practical example. In the plates 101 shown in various views in FIGS. 6 to 8, only the differences to the previously described plates 1 will bw explained.

Instead of snap-fastener studs, there are slightly tapered studs 102, 102' and 102'', and each of the holes 103, 103' and 103'' receiving the studs is formed by the gap between to clamping jaws **103*a*, which project from the plane of plate 101**.

There is a stop **103*b* inside each hole 103, 103' and 103'' in order to define the insertion depth of studs 102, and thus to stipulate the precise clearance between plates 101. Further stops 102*b* can be provided on each stud 102 in the direction of the joint which is adjacent to the free ends of clamping jaws 103*a* when two plates 101 are assembled to form a clamp. The height of studs 102 and of clamping jaws 103*a* is at least 1 millimeter (0.04 in) less than the thickness of the tile, so that no projections whatsoever from rear plates 101 extend from the joints after front plates 101** are removed.

Plate 101 has a total of eight pairs of spring tongues 106, which are formed integrally and which extend longitudinally at an angle of about 30° from a vertical median line.

In addition to a predetermined breaking line 113, which permits plate 101 to be divided longitudinally, there is also a further predetermined breaking line 114 parallel to the horizontal median line. This predetermined breaking line 114 extends at a distance from stud 102 and hole 103.

In order to improve the hold of the tiles in or at room corners, a corner stop 115 is formed onto the longitudinal edge of plate 101 in the center between the hook-shaped noses 104 arranged thereon; the tiles which form the actual corner can be in a supporting relationship with corner stop 115, especially in the case of outer corners. The material used for the fixing clamps of the embodiment is polystyrene of middle impact resistance. Other materials can be used.

In actual practice, it is possible to provide further application possibilities, e.g. it is also possible to construct walls designed entirely of tiles, i.e. to anchor two parallel tile walls one with the other with the aid of the fixing clamps. It is also possible to assemble fixing clamps in a parallel manner so as to form partitions of any desired thickness. Although the fixing clamps were described in their application with wall tiles, the individual plates 1 or 101 can also be employed by those without any skill in the art for stipulating the joints of floor tiles.

Obviously, many modifications and variations of the present invention are possible in the light of the above teachings. It should therefore be understood tht within the scope of the appended claims, the invention may be practiced otherwise than as specifically described.

I claim:

1. A fixing clamp for laying wall tiles, the fixing clamp comprising: a rear plate and a front plate, each plate having a front and rear surface, means for releasably connecting the front and rear plates to each other and for maintaining the plates at a predetermined distance from one another in a connected condition, said connecting means including at least one plug arranged on one of the plates and at least one socket arranged on the other of the plates for receiving said at least one plug, and wherein at least one of the plates is provided with at least one projection extending out of the plane of the plate on the front surface thereof and a plurality of projections extending out of the plane of the rear surface thereof, said at least one projection and said plurality of projections being arranged on the respective surfaces of the plate such that, in a first connected condition of the plates, said at least one projection defines a single joint, and in a second connected condition of the plates, said plurality of projections defines two intersecting joints.

2. The fixing clamp according to claim 1, wherein at least one plug and at least one socket is provided on each plate with the plugs and sockets being arranged on the respective plates in the same distance pattern.

3. The fixing clamp according to claim 2, wherein the plugs are arranged on at least one surface of each plate.

4. The fixing clamp according to claim 3, wherein the plugs and sockets are arranged on both surfaces of each plate.

5. The fixing clamp according to claim 2, wherein the plugs and sockets are arranged on the respective plates such that the plugs on one of the plates can be brought into registry with the sockets on the other of the plates by rotating one of the plates about an axis extending at right angles to the plane of the plates.

6. The fixing clamp according to claim 1, wherein, on at least one of said plates, at least one of said projections defining one of the single and intersecting joints simultaneously functions as the means for releasably connecting the plates to each other.

7. The fixing clamp according to claim 6, wherein the at least one projection simultaneously fucntioning as the releasable connecting means includes a stop surface for defining an insertion depth of a projection provided on the other of said plates when the plates are assembled.

8. The fixing clamp according to claim 7, wherein the at least one projection simultaneously functioning as the releasable connecting means has an axial length which is less than the predetermined distance between the plates in the connected condition.

9. The fixing clamp according to claim 1, wherein the at least one plug arranged on one of the plates is a stud, and wherein the at least one socket is a hole for receiving said stud.

10. The fixing clamp according to claim 9, wherein a plurality of plugs and holes are provided, and wherein said studs and said holes each have a tapered configuration.

11. The fixing clamp according to claim 10, wherein the holes are formed by a gap between two clamping jaws arranged at a distance one from the other.

12. The fixing clamp according to claim 11, wherein the studs are fashioned as separate components, and wherein holes are provided in the two plates for receiving respective ends of said studs.

13. The fixing clamp according to claim 9, wherein a predetermined breaking point is provided for connecting the stud with the plate.

14. The fixing clamp according to claim 1, wherein the plug and socket connection is of the engagement type.

15. The fixing clamp according to claim 1, wherein at least one stop means is provided for limiting an insertion depth of the plug and socket connection.

16. The fixing clamp according to claim 1, wherein the plug and socket connections are arranged at a predetermined distance from the edges of the respective plate.

17. The fixing clamp according to claim 1, wherein means are provided for connecting two plates to each other at an angle.

18. The fixing clamp according to claim 17, wherein said means for connecting two plates at an angle includes a U-shaped hook arranged in the plane of at least one of the plates.

19. The fixing clamp according to claim 18, wherein the two plates are connected at an angle so as to form a corner, and wherein at least one projection is arranged in the plane of one of the two plates and is aligned toward the corner.

20. The fixing clamp according to claim 19, wherein said last-mentioned projection is arranged on a side of the plate facing away from the means for connecting two plates at an angle.

21. The fixing clamp according to claim 19, wherein said last-mentioned projection is arranged on a side of the plate facing the means for connecting two plates at an angle.

22. The fixing clamp according to claim 21, wherein the projections are provided with a predetermined breaking point so as to permit the projection to be selectively broken off during an assembly of the fixing clamp.

23. The fixing clamp according to claim 22, wherein the predetermined breaking point of the projections is set back from an edge of the plate.

24. The fixing clamp according to claim 1, wherein means are provided for reinforcing the thickness of the plates to a thickness corresponding to a width of a joint at least in an area of a periphery of the respective plates.

25. The fixing clamp according to claim 1, wherein at least one of the front and rear plates is provided with at least one spring tongue projecting beyond the plane of the plate for compensating for irregularities in the fixing clamp.

26. The fixing clamp according to claim 1, wherein at least one of the front and rear plates is provided with at least one predetermined breaking line so as to permit a selective dividing of the plate along said line.

27. The fixing clamp according to claim 1, wherein at least one of the front and rear plates includes an opening in the area of the intersecting joints for facilitating alignment of the fixing clamp.

28. The fixing clamp according to claim 1, wherein the front and rear plates of the fixing clamp are designed in the same manner.

29. The fixing clamp according to claim 1, wherein the front and rear plates are provided with side edges, and wherein the respective edges of the plates are rounded or bevelled on both sides.

30. The fixing clamp according to claim 1, wherein the front and rear plates are of a generally rectangular configuration and wherein the joints defined by the projections extend parallel to edges of the plates.

31. The fixing clamp according to claim 30, wherein at least one plate includes at least one predetermined breaking line extending parallel to an edge of the plate so as to permit selective dividing of the plate along said line.

* * * * *